US006678653B1

(12) United States Patent
Tsushima et al.

(10) Patent No.: US 6,678,653 B1
(45) Date of Patent: Jan. 13, 2004

(54) APPARATUS AND METHOD FOR CODING AUDIO DATA AT HIGH SPEED USING PRECISION INFORMATION

(75) Inventors: Mineo Tsushima, Katano (JP); Takeshi Norimatsu, Kobe (JP); Shuji Miyasaka, Neyagawa (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 523 days.

(21) Appl. No.: 09/657,461

(22) Filed: Sep. 7, 2000

(30) Foreign Application Priority Data

Sep. 7, 1999 (JP) ..... 11-252700

(51) Int. Cl.[7] ..... G10L 19/02

(52) U.S. Cl. ..... 704/220; 704/200.1; 704/229; 704/219; 704/230; 704/262

(58) Field of Search ..... 704/220, 200.1, 704/219, 229, 230, 262, 222, 205, 206, 500–504, 223, 248, 268, 263, 264

(56) References Cited

U.S. PATENT DOCUMENTS 5,481,614 A 1/1996 Johnston
5,592,584 A 1/1997 Ferreira et al.
5,794,179 A * 8/1998 Yamabe ..... 704/205
5,930,750 A * 7/1999 Tsutsui ..... 704/229
6,018,707 A * 1/2000 Nishiguchi et al. ..... 704/222
6,199,038 B1 * 3/2001 Tsutsui ..... 704/229
6,415,251 B1 * 7/2002 Oikawa et al. ..... 704/200.1

OTHER PUBLICATIONS

International Standard, Information technology—Generic coding of moving pictures and associated audio information—Part 7: Advanced Audio Coding (AAC), ISO/IEC 13818–7, 1997, pp 136–141, Switzerland.

* cited by examiner

*Primary Examiner*—Vijay Chawan
(74) *Attorney, Agent, or Firm*—Smith Patent Office

(57) ABSTRACT

An audio signal is converted from time domain into frequency conversion signal, and is coded at high speed. In order that the frequency information decoded by using the quantizing data may not be zero when the frequency conversion signal is quantized, the guarantee value K(B) of the quantizing precision is calculated. The relative quantizing precision SF(B) in each band and the quantizing precision information Com common to all bands are determined, and final quantizing precision information ASF(B) are calculated by these values, and the frequency conversion signal is quantized in the quantizing unit. Thus, it is possible to quantize by a single quantizing loop, only on the restricting condition of assuring the minimum quantizing information.

22 Claims, 6 Drawing Sheets

APPARATUS AND METHOD FOR CODING AUDIO DATA AT HIGH SPEED USING PRECISION INFORMATION

BACKGROUND OF THE INVENTION

1. Field of the Invention

The present invention relates to a data coding apparatus and data coding method for audio signal such as voice signal and music signal. More particularly, it relates to a data coding apparatus generating a frequency conversion signal by converting from time domain into frequency domain by using quadrature conversion or other technique, compressing the data by a smaller coding quantity, and generating a encoded bit stream at high speed in order to express at high sound quality.

2. Discussion of the Related Art

Many systems have been developed hitherto as audio signal data coding methods, and some are put in actual use. There are two types of data coding methods for audio signal, namely a fixed bit rate method and a variable bit rate method. ADPCM and Dolby-AC3 are known as the fixed bit rate methods. An advanced audio coding, hereinafter refers to as an AAC, is known as the variable bit rate coding. The AAC is internationally standardized by the ISO/IEC in the IS13818-7, and evaluated as a data coding method of high sound quality and high efficiency. The IS13818-7 of the ISO/IEC is the standard of decoding process and coding format, but the data coding method itself is not designated. In the AAC, signal of each frequency band is compressed on different compressing parameters not on a common parameter. And high sound quality and high efficiency can be obtained based on proper compressing parameters, in each frequency band.

However, in the AAC, inadequate parameter selection causes reduce of compressing rate, or lack in spectrums. And the lack in spectrum frequency causes much distortion when reproducing the coded signal. Furthermore, it requires much processing power when coding in the AAC system and it is difficult for audio and video apparatus of home appliance to encode input signal on the real time basis.

SUMMARY OF THE INVENTION

The invention is to solve the problems of the conventional method. It is an object of the invention to provide a data coding apparatus and data coding method which decrease the quantity of calculation, and hence issue the encoded bit stream at high speed. It is also an object to decode the audio signal optimally so that the reproduced sound may have a high sound quality.

The present invention is a data coding apparatus for quantizing and coding an audio signal divided into plural frequency bands at a quantizing precision determined in each frequency band, and comprises a relative quantizing precision decision unit, a quantizing precision guarantee value decision unit, a quantizing processing unit, and a coding unit.

The relative quantizing precision decision unit calculates relative quantizing precision information used in quantizing from representative frequency information, where the representative frequency information is a representative or maximum value of the amplitude of each frequency band, and the relative quantizing precision information is quantizing precision information relative to the amplitude of each frequency band.

The quantizing precision guarantee value decision unit calculates a guarantee value of quantizing precision information which is the quantizing precision information to have a minimum assured amplitude when decoding in each frequency band.

The quantizing processing unit quantizes at a quantizing precision of each frequency band that is higher than or equal to the quantizing precision indicated by the guarantee value of the quantizing precision information, by using the output value of the relative quantizing precision decision unit and the output value of the quantizing precision guarantee value decision unit.

The coding unit codes the information quantized in the quantizing processing unit, and generates audio coded data, and the quantizing processing unit quantizes so that the coded data from the coding unit is less than or equal to the predetermined information quantity.

DETAILED DESCRIPTION OF THE PREFERRED EMBODIMENTS

Figure 1:
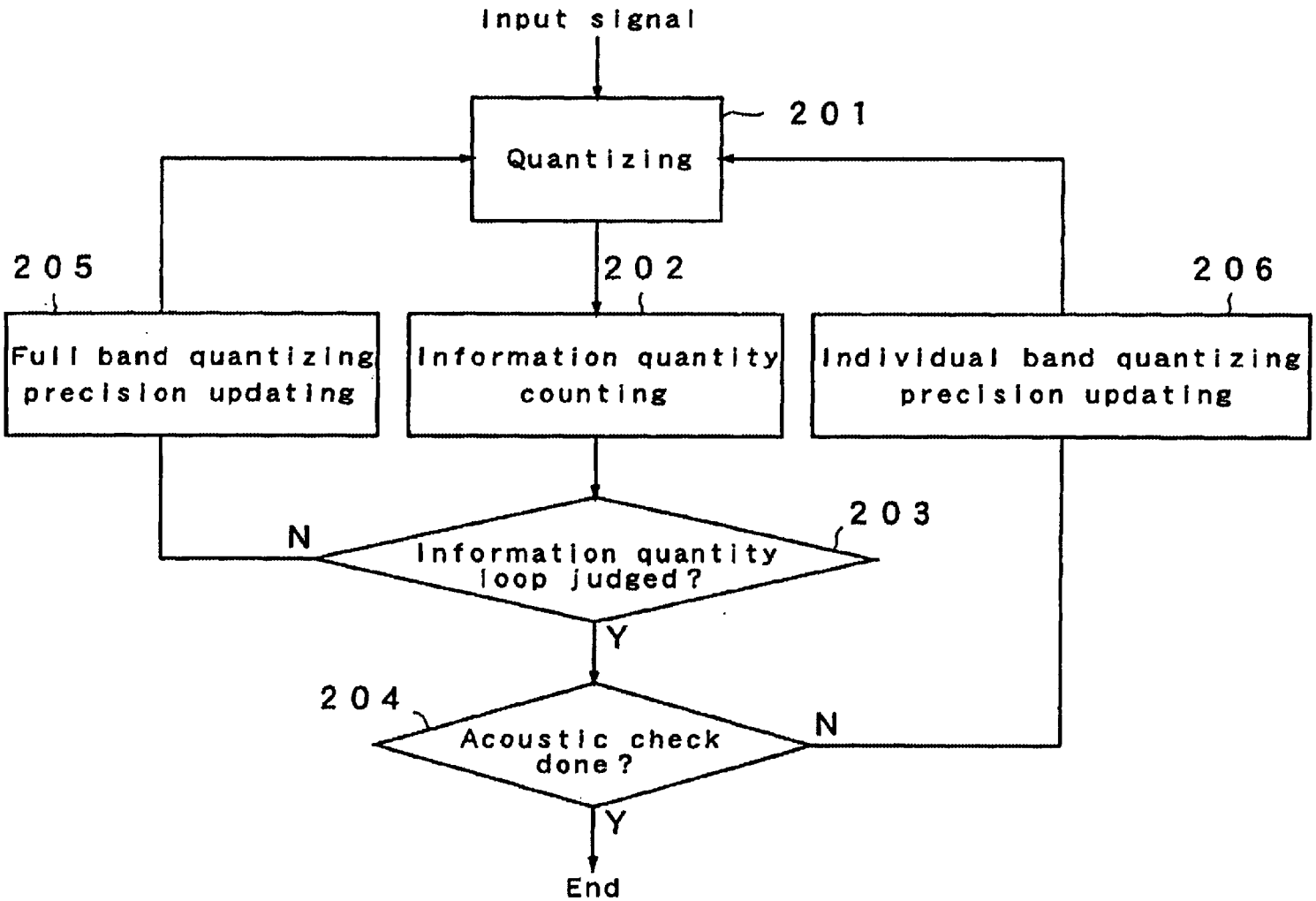
FIG. 1 (Prior Art)
FIG. 1 is a flowchart showing the operation of a data coding apparatus in the AAC.

An audio data coding method for the abovementioned AAC is explained below. FIG. 1 is a flowchart showing the operation the audio data coding method. This audio data coding method comprising a quantizing step 201, an information quantity counting step 202, an information quantity loop judging step 203, an acoustic checking step 204, a full band quantizing precision updating step 205, and an individual band quantizing precision updating step 206.

A principal aim of audio coding is to compress the audio signal into a desired limited information quantity with keeping original sound quality. An audio discrete signal is converted into data on the frequency axis through time-frequency converting means not shown, and is given to the quantizing step 201. At the quantizing step 201, input signal is quantized on the basis of the full band quantizing precision information from the full band quantizing precision updating step 205. At the information quantity counting step 202, it is counted to see that the quantizing result at the quantizing step 201 can be expressed in how much information quantity. At the information quantity loop-judging step 203, it is judged whether the output of the information quantity counting step 202 is less than or equal to a predetermined information quantity or not. When the output of the information quantity counting step 202 is less than or equal to the predetermined information quantity, the subsequent process is transferred to the acoustic checking step 204. When the output of the information quantity counting step 202 is more than the predetermined information quantity, the process is transferred to the full band quantizing precision updating step 205.

The updating step 205 manages the precision information to be quantized at the quantizing step 201 over the full band. Supposing the full band quantizing precision information before updating to be common scale factor Com, the updating step 205 give the value such as common scale factor Com+1 to the quantizing step 201 as the updated full band quantizing precision information. The quantizing step 201 quantizes the input signal again by using the updated full band quantizing precision information.

When the audio signal is divided into plural frequency bands B, the amplitude of each frequency band B is the frequency information. At the acoustic checking step 204, it is inspected in every divided frequency band B whether the quantized frequency information is within the audibly permitted quantizing noise or not. Herein, the value of the audibly permitted quantizing noise is the value obtained from the known psychoacoustic model. When the quantizing noise in all of the divided frequency bands B is within the audibly permitted noise level, a series of quantizing process is terminated. If the quantizing noise is over the audibly permitted noise level, the process is transferred to the individual band quantizing precision updating step 206. At the step 206, the band quantizing precision information about the frequency band over the permitted noise level of quantizing noise is updated. For example, the band quantizing precision information scale factor SF(B) corresponding to the frequency band B is updated to scale factor SF(B)+1.

This data coding apparatus includes a first loop of repeating quantizing while judging whether the information quantity is within the prescribed information quantity or not at the loop judging step 203, and a second loop of repeating quantizing while judging whether the quantizing noise is within the acoustically permitted noise level or not at the acoustic checking step 204 provided at the outer side thereof. Therefore, the coding process is composed of double loops.

In such constitution, however, the number of turns of the two loops may be extremely large for inputs of various audio signals, and the quantity of calculation increases. It is also a problem if not reaching the target quantizing noise level at the updating step 205 and updating step 206, resulting in poor sound quality.

Embodiment 1

Figure 2:
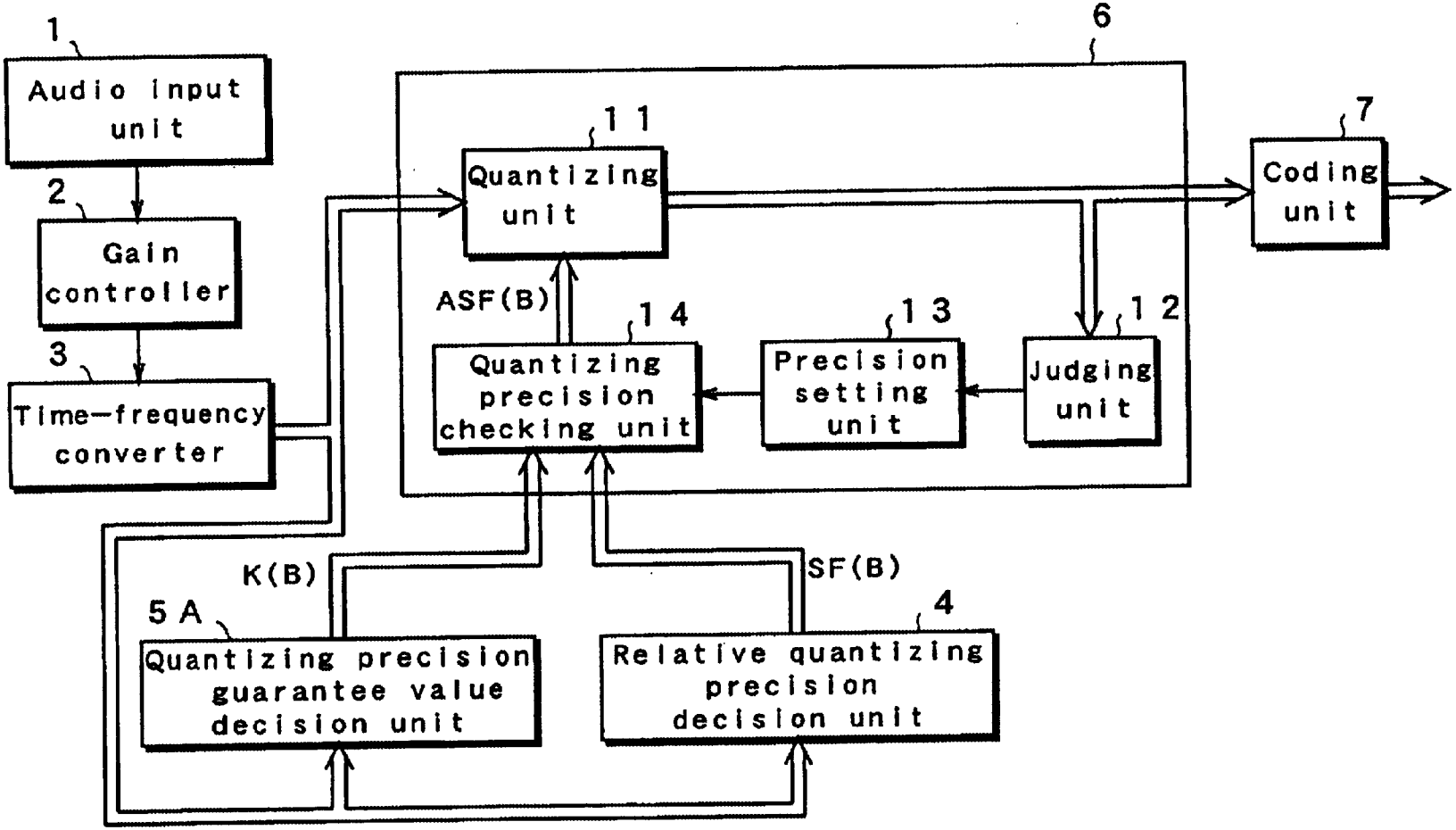
FIG. 2 is a structural diagram of a data coding apparatus in an embodiment 1 of the invention.

FIG. 2 shows a structural diagram showing a data coding apparatus in an embodiment 1 of the invention, and its peripheral circuit blocks. In the diagram, an audio input unit 1 is for input of audio signal, and the signal is given to a time-frequency converter 3 by way of a gain controller 2. The time-frequency converter 3 is to convert the input signal into signals divided into several frequency bands by using quadrature conversion or other technique. The output of the time-frequency converter 3 is fed into a relative quantizing precision decision unit 4, a quantizing precision guarantee value decision unit 5A, and a quantizing processing unit 6. The quantizing processing unit 6 is for quantizing the frequency information divided into a plural of frequency bands at the quantizing precision determined in each frequency band. The relative quantizing precision decision unit 4 receives the frequency information of each frequency band before quantizing, and calculates relative quantizing precision information, for example, in each frame. The relative quantizing precision information is information of the quantizing precision relative to the amplitude of each frequency band. The quantizing precision guarantee value decision unit 5A receives the frequency information in each frequency band, and calculates quantizing precision information guarantee values in each frame. The guarantee value of the quantizing precision information is quantizing precision calculated so as to have minimum limit amplitude to be held in each band. The quantizing processing unit 6 is to quantize optimally by using the quantizing precision determined in these decision units 4, and 5A. The unit 6 comprises a quantizing unit 11, a judging unit 12, a precision setting unit 13, and a quantizing precision checking unit 14.

The full band quantizing precision information to be common scale factor Com, the relative quantizing precision information determined by the relative quantizing precision decision unit 4 is scale factor SF(B), and the quantizing precision information determined by the quantizing precision guarantee value decision unit 5A is guarantee value K(B). The quantizing precision checking unit 14 in the quantizing processing unit 6 calculates the absolute scale factor ASF(B) which is the absolute quantizing precision information in each frequency band to be quantized actually, by using the initial value of the common scale factor Com, scale factor SF(B), and guarantee value K(B).

The quantizing unit 11 quantizes the frequency information of each frequency band on the basis of the absolute scale factor ASF(B) in each band. The judging unit 12 calculates the information quantity (bit rate) necessary for coding the frequency information quantized by the quantizing unit 11. When the obtained information quantity is smaller than a predetermined information quantity for coding in a coding unit 7, the loop processing for changing the absolute scale factor ASF(B) is terminated. On the other hand, when the obtained information quantity is larger than the predetermined information quantity for coding in the coding unit 7, the subsequent process applies an output to the precision setting unit 13. The precision setting unit 13 is to instruct the quantizing precision checking unit 14 to vary the common scale factor Com which is the full band quantizing precision information. The coding unit 7 is for coding by adding an error correction code to the audio data quantized by the quantizing unit 11, and converting into a format of transport stream or program stream.

The data coding apparatus of the embodiment purposes to quantize the converted value of the input of the audio time signal being converted into a signal in a frequency domain from the time domain signal, such as modified cosine transform (hereinafter refers to as an MDCT), to reduce the information quantity of audio signal when coding, and to quantize with a small deterioration of sound quality acoustically. For example, the MDCT coefficient obtained by the MDCT transform is used as the converted value, and this case is explained below.

The relative quantizing precision decision unit 4 calculates the relative quantizing precision information in each frequency band B capable of adjusting the quantizing precision from the entered MDCT coefficient. For example, in the data coding apparatus such as AAC, a frequency band is called scale factor band B, and the quantizing precision information can be selected in each scale factor band B.

On the other hand, when the signal is inputted by the frame unit, the quantizing precision guarantee value decision unit 5A calculates the guarantee value K (B) of the quantizing precision information to be assured as a minimum limit, so that the signal may not be eliminated from the band when reproduced in each frequency band.

Next, in the quantizing precision checking unit 14, the absolute scale factor ASF(B) which is the absolute quantizing precision information in each frequency band to be quantized actually is determined, from the initial value of the common scale factor Com, scale factor SF(B) calculated by the relative quantizing precision decision unit 4, and guarantee value K(B) calculated by the quantizing precision guarantee value decision unit 5A.

The quantizing unit 11 quantizes on the basis of the absolute scale factor ASF(B). The judging unit 12 counts to see the quantizing value being quantized by the quantizing unit 11 can be coded in what quantity of information, and judges if the counting value is below the predetermined audio information quantity or not. If the counting of the information quantity judged at the judging unit 12 is smaller than or equal to the predetermined quantity, it is coded in the coding unit 7, and if larger than the predetermined quantity, the subsequent process is transferred to the precision setting unit 13. The precision setting unit 13 instructs the quantizing precision checking unit 14, for example, to add a value of 1 or more to the present common scale factor Com. As a result, the information quantity to be obtained finally is decreased, and the quantized audio data is coded by the coding unit 7.

Explained below are the specific operation examples of the relative quantizing precision decision unit 4, quantizing precision guarantee decision unit 5, and quantizing precision checking unit 14, by referring to the flowchart in FIG. 3 and graph in FIG. 4. For example, in a compact disc system, an audio signal is sampled at sampling frequency of 44.1 kHz, and a PCM signal of 16 bits is obtained. The information quantity in one channel is 705.6K bits/sec. Suppose it is compressed to 64K bits/sec, that is, less than 1/10. In the case of the AAC, an encoded bit stream is issued in every 1024 samples of PCM. Since 1024 samples are 23.22 msec long, the compressed code quantity assigned in one frame is 1486 bits. Therefore, the number of bits to be used as the predetermined index judged by the judging unit 12 is 1486 bits in this case. Or when compressed to about 1/20, that is, 32K bits/sec, the predetermined index bits are 763 bits.

In the AAC system, the frequency information of MDCT coefficient is quantized into an integer value, and coded. The MDCT coefficient is Mdct(i) (i being an integer of 0 to 1023). This MDCT coefficient is quantized into an integer value, and is coded. The formula when converting the MDCT coefficient into an integer value is given as follows:

$$Xquant(i)=(int)\{Mdct(i)^{(3/4)}\times 2^{(3\cdot(SF(B)-Com)/16)}\} \quad (1),$$

where (int) is an integer operator for returning the value of the subsequent formula in an integer value, SF(B) is a scale factor in band B, and Com is common scale factor. The scale factor SF(B) is a variable depending on the band B, and the common scale factor Com is a common variable regardless of the band B.

Supposing to convert the audio signal on the time axis to a signal on the frequency axis having a frequency range of $f_0$ to $f_s$, in this case, $f_0$ to $f_s$ are divided into plural divisions, and the division points are called 1, 2, . . . , j, j+1, . . . , k, k+1, . . . , s−1 ($0 \leqq j < k \leqq s$). Supposing the frequency band from division points j to k to be frequency band $B(f_j$ to $f_k)$, the MDCT coefficients belonging to the frequency band B are Mdct(j) to Mdct(k). In this case, the scale factor SF(B) is expressed, for example, in the following formula (2):

$$SF(B)=\alpha\cdot\log(\text{Max } Mdct(B)+1.0) \quad (2),$$

where α is a constant. MAX operator issues the maximum value of the element in the operator, and Max Mdct(B) is expressed in the following formula:

$$\text{Max } Mdct(B)=\text{Max}\{Mdct(j), Mdct(j+1) \ldots, Mdct(k)\}.$$

Hence, in each frequency band B, the maximum value may be obtained as a representative frequency information.

Similarly, the scale factor SF(B) may be calculated in the following formula (3):

$$SF(B)=\alpha\cdot\log\left(\sum_{j}^{k} Mdct(i)\cdot Mdct(i)+1\right). \quad (3)$$

In this case, the sum of $Mdct(i)^2$ is the representative frequency information.

The scale factor obtained by using the formula (2) or (3) is limited by restrictions of data coding method. For example, in the case of AAC, there is a limitation that differences between adjacent scale factors SF(B) should be within plus or minus 60, and hence it can be adjusted by the value of the constant α in the formula (2) or (3). In the light of the coding efficiency, the consumption of information quantity is smaller, in some case, by decreasing the fluctuation of the scale factor SF(B), for example, the value of the scale factor SF(B) may be processed by smoothing.

Figure 3:
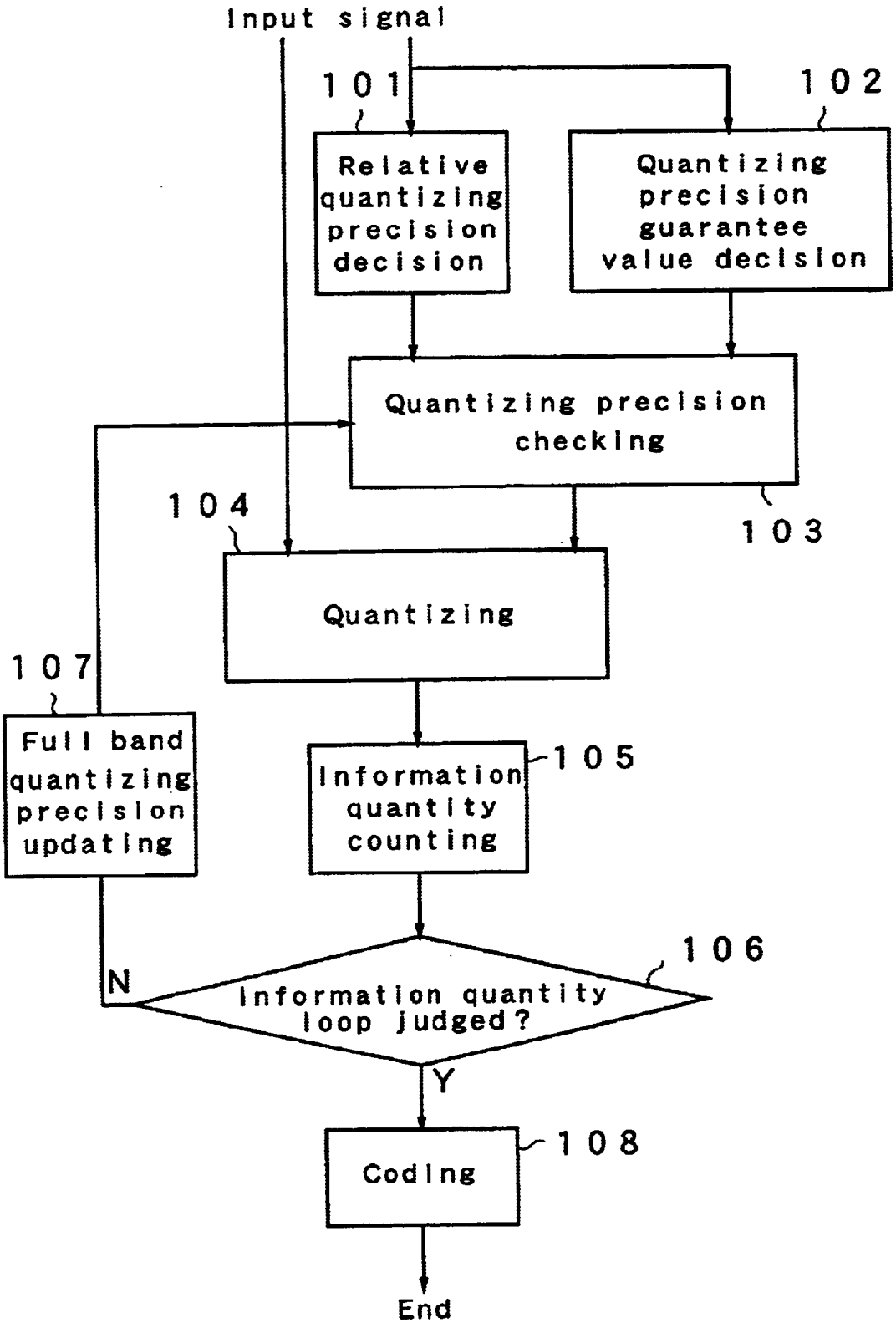
FIG. 3 is a flowchart showing the operation of the data coding apparatus in the embodiment 1 of the invention.

In the flowchart shown in FIG. 3, at the step 101, the scale factor SF(B) is calculated from the input signal Mdct(i) by using the formula (2) or (3). In the formula (1), when SF(B)−Com is set smaller, Xquant(i) becomes an integer of a smaller absolute value, and it soon comes to zero. On the other hand, when SF(B)−Com is set larger, Xquant(i) becomes an integer of a larger absolute value. Since the calculation formula of the decoded Mdct(i) using the coded Xquant(i) is an inverse conversion, the decoded Mdct(i) is expressed in the following formula:

$$Mdct(i)=Xquant(i)^{(4/3)}\times 2^{((Com-SF(B))/4)}.$$

When coding by selecting SF(B)−Com so that Xquant(i) becomes zero, the Mdct(i) reproduced at the time of decoding becomes zero, and the i-th frequency component also becomes zero.

On the other hand, the quantizing precision guarantee value decision unit 5A sets the guarantee value K(B) of the quantizing precision information having the minimum information consumption so that the information consumption in quantizing may not be zero, in each quantizing band, except when all input values Mdct(j) to Mdct(k) are zero in each quantizing band (B) (step 102). As a result, even if the information is compressed at a large rate, we can listen to music naturally at the time of reproduction. In the case of the AAC, since the quantizing value of the MDCT coefficient is an integer value, the guarantee value K(B) is calculated so that at least one absolute value of the quantizing values in a certain band may be 1 or more. For example, supposing Mdct(i) to be a positive value, it is the condition that at least one absolute value of Xquant(i) is 1. If Mdct(i) is a positive value, SF(B)−Com may be calculated to satisfy the following formula:

$$(int)\{Mdct(i)^{(3/4)}\times 2^{(3(SF(B)-Com)/16)}\}=1.$$

This is the guarantee value K(B) by the unit 5A. In other words, $$(int)\{Mdct(i)^{(3/4)}\times 2^{(3\cdot k(B)/16)}\}=1.$$

However, since the guarantee value K(B) is one value to be set in each band B, the maximum amplitude out of the MDCT coefficients in the band B is selected, and the guarantee value K(B) is calculated in the following formula:

$$(int)\{\text{Max } Mdct(B)^{(3/4)}\times 2^{(3\cdot k(B)/16)}\}=1 \quad (4).$$

Thus, at least in this band B, one spectrum is not zero at the time of decoding.

In the quantizing precision checking unit 14, the absolute scale factor ASF(B) applied in the quantizing unit 11 is calculated in the following formula (5):

$$\text{If } K(B)<SF(B)-\text{Com}, ASF(B)=SF(B)-\text{Com} \text{ If } K(B)\geqq SF(B)-\text{Com}, ASF(B)=K(B) \quad (5).$$

In this way, the absolute scale factor is issued at the quantizing precision checking step 103, and it is quantized at the quantizing step 104. As a result, one predicts to be quantized in a state shown in a schematic diagram in FIG. 4. In the state in FIG. 4A, the curve 21 showing SF(B)−Com is larger than the curve 22 of the guarantee value K(B) in any frequency band. If the information quantity calculated in the judging unit 12 is larger than the predetermined information quantity, the process is transferred to the precision setting unit 13. In the precision setting unit 13, the common scale factor Com in all bands is updated so that, for example, the value of the Com may be larger than the initial value by 1 (step 107). This example is shown in FIG. 4B. Herein, in a certain band, the curve 22 of the guarantee value K(B) is larger than the curve 21 showing SF(B)−Com. Therefore, from the formula (5), K(B) is ASF(B) in that hands. As a result, in the quantizing precision checking unit 14, the absolute scale factor ASF(B) is calculated again (step 103). In the diagram, the curve 23 of thick line denotes the absolute scale factor ASF(B) for quantizing in the quantizing unit 11.

Figure 4A:
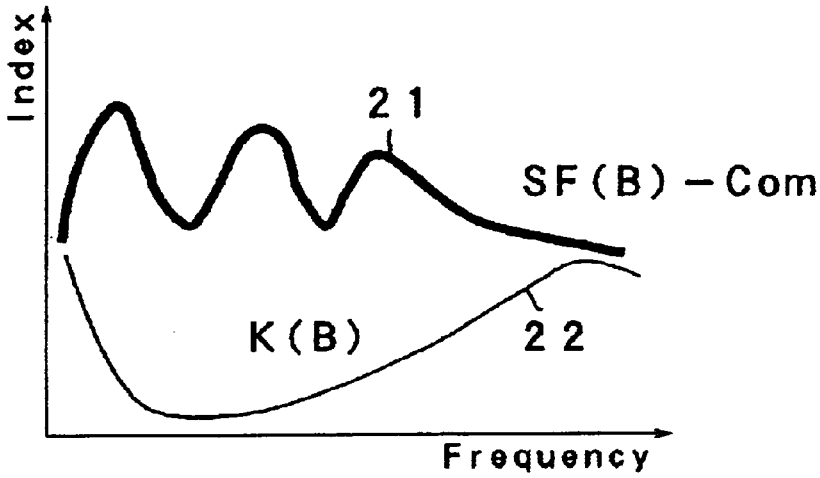
FIG. 4A to FIG. 4C are schematic diagrams showing the state of coding process in the data coding apparatus in the embodiment 1 of the invention.
Figure 4A:
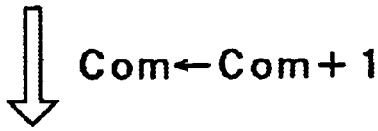
Figure 4B:
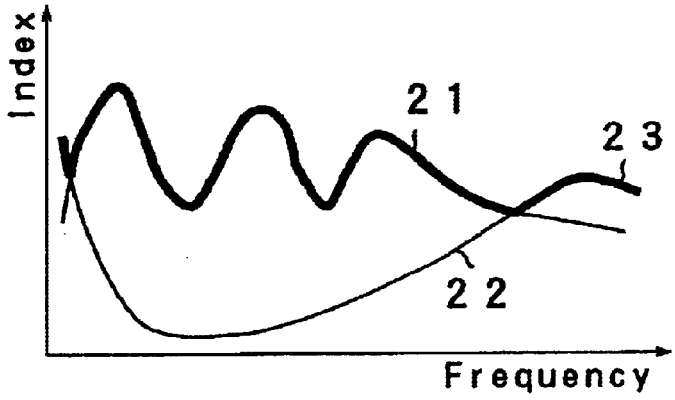
Figure 4B:
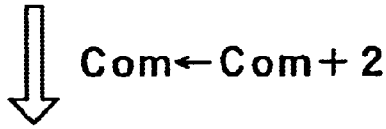
Figure 4C:
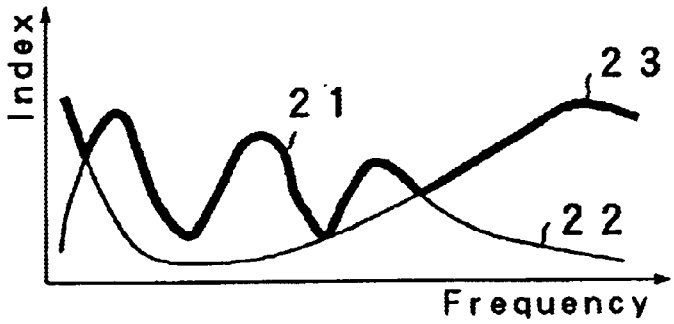

In any case of FIGS. 4A to 4C, the curve 23 of absolute scale factor ASF(B) is calculated by the formula (5). Calculation is repeated until the information quantity calculated at the step 105 is judged to be smaller than or equal to the predetermined information quantity at the information quantity loop-judging step 106. When judged to be smaller than or equal to the predetermined information quantity at the step 106, advancing to a step 108, the coding is processed, and the process is over.

In the embodiment 1, the loop is started from the state in which the coded information quantity is larger than the index bits in the judging step 106, and the loop of full band quantizing precision information is stopped when becomes smaller than or equal to the predetermined index bits. But it may be also designed to stop the quantizing precision updating loop when becoming within a specified range below the index bits. Or, the loop may be started from the state smaller in the coded information quantity, and the value of Com is decreased, the loop may be stopped when coming into the specified range below the index bits.

A suitable device provided with a computer can perform the operation described in FIG. 3. The computer includes a computer-readable storage medium embodying program instructions for the method in FIG. 3.

The data coding apparatus in FIG. 1 is in a double loop structure, whereas the data coding apparatus of the invention is in a single loop structure, and therefore the calculation quantity is smaller than in the data coding apparatus of FIG. 1. Accordingly, when realizing by using the hardware such as DSP, the power consumption can be saved, and the chip size is smaller in the IC structure, among other excellent effects. Moreover, in each frequency band, at least one spectrum is guaranteed at the time of reproducing obtained, and the sound quality is superior.

Embodiment 2

Figure 5:
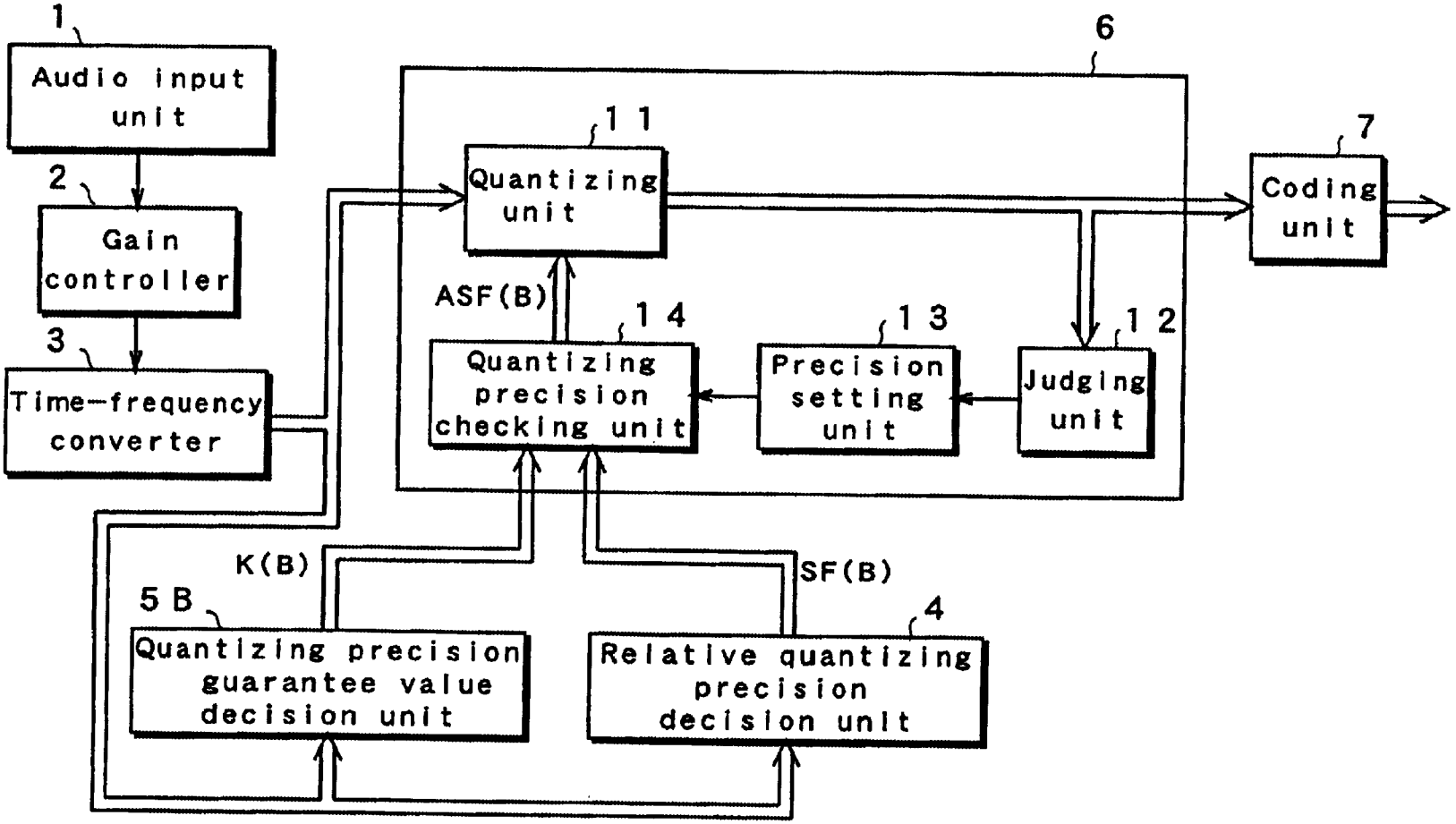
FIG. 5 is a structural diagram of a data coding apparatus in an embodiment 2 of the invention.

A data coding apparatus in an embodiment 2 of the invention is explained by referring to FIG. 5. The data coding apparatus of this embodiment is basically same in structure as the data coding apparatus of the embodiment 1, and same components are identified with same reference numerals and detailed description is omitted. In this embodiment 2, the quantizing precision guarantee value decision unit 5B is different.

In the embodiment 1, the value calculated in the quantizing precision guarantee value decision unit 5A is set in each quantizing band as the quantizing precision information having the minimum information consumption so that the information quantity used in quantizing may not be zero. In the quantizing precision guarantee value decision unit 5B in the embodiment 2, the guarantee value of quantizing precision information of auditory minimum limit is calculated in imitation of the human psychoacoustic model in each band.

For example, it is possible to use the silent audible characteristic, or so-called minimum audible characteristic, as designated in the standard of Layer 1 to Layer 3 of MPEG1 of ISO/IEC 11172-3. When all input frequency characteristics in a certain band are smaller than the minimum auditory characteristic, the frequency components in this band are not sensed. Therefore, if all input frequency characteristics in the band are not zero, the information quantity is set to zero regardless of the output value in the quantizing precision guarantee value decision unit 5B. As the minimum auditory characteristic, Layer 1 to Layer 3 of MPEG1 are cited, but other standards may be similarly employed. In such data coding apparatus, a further enhancement of sound quality is expected than in the embodiment 1.

Figure 6:
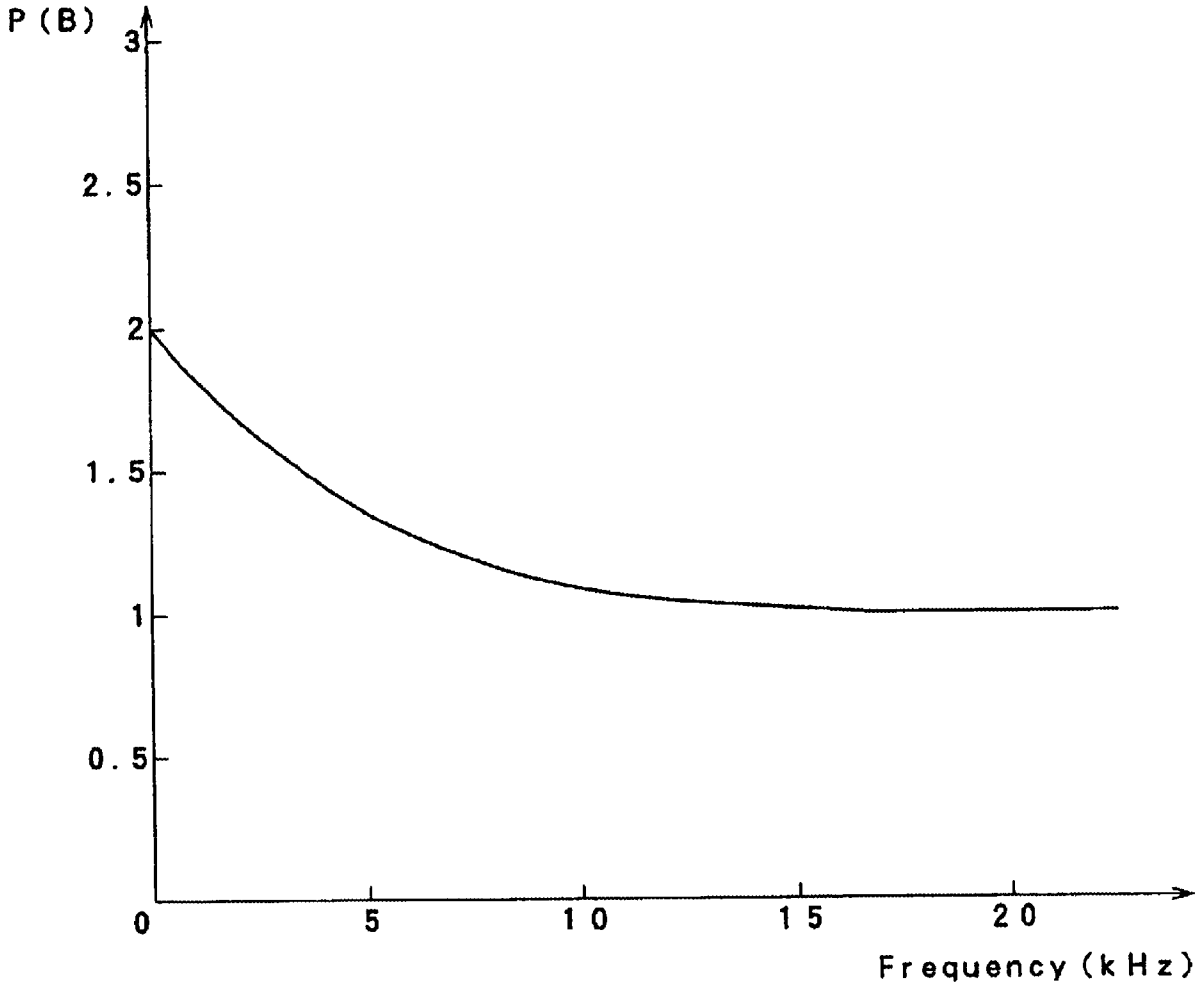
FIG. 6 is a graph showing an example of auditory characteristic variable P (B) used in the embodiment 2.

In the human hearing characteristic, it is known that the resolution is higher in lower frequency bands and is lower in higher frequency bands. Generally, it is preferable for listeners to reduce the distortion due to quantizing error in lower frequency bands. Therefore, by varying the calculating method of the guarantee value K(B) depending on the band B, distortion is controlled, so that more audible coded sound may be presented. In the embodiment 1, using the MDCT coefficient Max Mdct(B) of the maximum amplitude in band B, the guarantee value K(B) is calculated in the formula (4). In the embodiment 2, the guarantee value K(B) is calculated in the following formula:

$$(\text{float})\{\text{Max } Mdct(B)^{(3/4)}\times 2^{(3\cdot k(B)/16)}\}=P(B),$$

where (float) means returning of the value in the subsequent formula by the value of floating decimal point. Herein, the audible characteristic variable P(B) in the band B is changed depending on the input bands. For example, the variable P(B) is set larger at lower frequency of higher audible resolution and smaller at higher frequency of lower resolution as shown in FIG. 6. Alternatively, the audible characteristic variable P(B) may be changed depending on the input signal. Using thus calculated guarantee value K(B), it is coded in the same manner as in the embodiment 1. Thus, in spite of a small quantity of calculation, sound of high quality can be presented.

Thus, according to the data coding apparatus of the invention, the calculation quantity of the quantizing unit is saved drastically as compared with that in the data coding apparatus in FIG. 1. Hence, if realizing by using the hardware such as DSP, the power consumption is small, and the chip size of IC structure is reduced. At the same time, the final sound quality can be enhanced.

It is be understood that although the present invention has been described with regard to preferred embodiment thereof, various other embodiments and variants may occur to those skilled in the art, which are within the scope and spirit of the invention, and such other embodiments and variants are intended to be covered by the following claims.

What is claimed is:

1. A data coding apparatus for quantizing and coding an audio signal divided into plural frequency bands at a quantizing precision determined in each frequency band, comprising:

a relative quantizing precision decision unit which calculates relative quantizing precision information used in quantizing from representative frequency information, where said representative frequency information is a representative value of the amplitude of each frequency band, and said relative quantizing precision information is quantizing precision information relative to the amplitude of each frequency band;

a quantizing precision guarantee value decision unit which calculates a guarantee value of quantizing precision information which is the quantizing precision information to have a minimum assured amplitude when decoding in each frequency band;

a quantizing processing unit which quantizes at a quantizing precision of each frequency band that is higher than or equal to the quantizing precision indicated by said guarantee value of said quantizing precision information, by using the output value of said relative quantizing precision decision unit and the output value of said quantizing precision guarantee value decision unit; and a coding unit which codes the information quantized in said quantizing processing unit, and generates audio coded data;

wherein said quantizing processing unit quantizes so that the coded data from said coding unit is less than or equal to the predetermined information quantity.

2. The data coding apparatus of claim 1, wherein said quantizing precision guarantee value decision unit calculates the guarantee value of the quantizing precision information so that at least one of the frequency spectrum decoded by using the quantizing precision information of the frequency band exceeds zero, when at least one of the frequency spectrum of the input signal is more than zero in each frequency band; and said quantizing processing unit quantizes the amplitude of each frequency band at the quantizing precision higher than or equal to the precision of the output of said quantizing precision guarantee value decision unit in each frequency band.

3. The data coding apparatus of claim 2, wherein said quantizing precision guarantee value decision unit calculates in each frequency band, as the guarantee value of the quantizing precision information, the higher quantizing precision in the lower frequency band, and the lower quantizing precision in the higher frequency band.

4. The data coding apparatus of claim 3, wherein said quantizing processing unit comprises:

a quantizing precision checking unit which calculates absolute quantizing precision information ASF(B) in each frequency band to be actually quantized, supposing each frequency band to be B, a common scale factor Com which is a specific full band quantizing precision information in all bands, a scale factor SF(B) which is said relative quantizing precision information determined in said relative quantizing precision decision unit, and said guarantee value K(B) of said quantizing precision information determined in said quantizing precision guarantee value decision unit;

a quantizing unit which quantizes frequency information on the basis of said absolute quantizing precision information ASF(B) in each frequency band calculated by said quantizing precision checking unit;

a judging unit which calculates the information quantity necessary for coding the quantized data quantized by said quantizing unit, judges the difference between the calculated information quantity and the predetermined information quantity, and terminates the quantizing process when the calculated information quantity is less than or equal to said predetermined information quantity; and a precision setting unit which instructs said quantizing precision checking unit to change said common scale factor Com when the information quantity calculated in said judging unit is judged to be larger than the predetermined information quantity.

5. The data coding apparatus of claim 4, wherein said quantizing precision checking unit sets the absolute quantizing precision information ASF(B) in each frequency band as the difference (SF(B)−Com) when the difference (SF(B)−Com) between the scale factor SF(B) and the common scale factor Com is larger than said guarantee value K(B); and sets the absolute quantizing precision information ASF(B) in each frequency band as said guarantee value K(B) when said difference (SF(B)−Com) is smaller than or equal to said guarantee value K(B).

6. The data coding apparatus of claim 5, wherein said quantizing precision guarantee value decision unit calculates the value K(B) based on the following formula:

$$(\text{float})\{\text{Max } Mdct(B)^{(3/4)}\times 2^{(3\cdot k(B)/16)}\}=P(B),$$

where, (float) means returning of the value in the subsequent formula by the value of floating decimal point, Mdct(i)(i=0, 1, . . . s) are coefficients of a modified cosine transformation, the frequency band B is frequency band frame $f_j$ to $f_k$ ($0f\leqq j<k\leqq s$) and audible characteristic variable P(B) is larger than 1 and the lower the frequency, the higher the level of P(B); and the Max Mdct(B) is shown as follows, $$\text{Max } Mdct(B)=\text{Max}\{Mdct(j), Mdct(j+1), \ldots, Mdct(k)\}.$$

7. The data coding apparatus of claim 1, wherein said quantizing processing unit comprises:

a quantizing precision checking unit which calculates absolute quantizing precision information ASF(B) in each frequency band to be actually quantized, supposing each frequency band to be B, a common scale factor Com which is a specific full band quantizing precision information in all bands, a scale factor SF(B) which is said relative quantizing precision information determined in said relative quantizing precision decision unit, and said guarantee value K(B) of said quantizing precision information determined in said quantizing precision guarantee value decision unit;

a quantizing unit which quantizes frequency information on the basis of said absolute quantizing precision information ASF(B) in each frequency band calculated by said quantizing precision checking unit;

a judging unit which calculates the information quantity necessary for coding the quantized data quantized by said quantizing unit, judges the difference between the calculated information quantity and the predetermined information quantity, and terminates the quantizing process when the calculated information quantity is less than or equal to said predetermined information quantity; and a precision setting unit which instructs said quantizing precision checking unit to change said common scale factor Com when the information quantity calculated in said judging unit is judged to be larger than the predetermined information quantity.

8. The data coding apparatus of claim 7, wherein said quantizing precision checking unit sets the absolute quantizing precision information ASF(B) in each frequency band as the difference (SF(B)−Com) when the difference (SF(B)−Com) between the scale factor SF(B) and the common scale factor Com is larger than said guarantee value K(B); and sets the absolute quantizing precision information ASF(B) in each frequency band as said guarantee value K(B) when said difference (SF(B)−Com) is smaller than or equal to said guarantee value K(B).

9. The data coding apparatus of claim 1, wherein said quantizing precision guarantee value decision unit calculates, as the guarantee value, the quantizing precision information of maximum limit at which the frequency information decoded by using the quantizing data obtained by quantizing the frequency band is not sensed audibly as noise, when at least one of the spectrums of the input signal is more than zero in each frequency band; and said quantizing processing unit quantizes the amplitude of each frequency band with the quantizing precision more than or equal to the precision issued by said quantizing precision guarantee value decision unit in all frequency bands.

10. A data coding apparatus for quantizing and coding an audio signal divided into plural frequency bands at a quantizing precision determined in each frequency band, comprising:

a relative quantizing precision decision unit which calculates relative quantizing precision information used in quantizing from representative frequency information, where said representative frequency information is a maximum value of the amplitude of each frequency band, and said relative quantizing precision information is quantizing precision information relative to the amplitude of each frequency band;

a quantizing precision guarantee value decision unit which calculates a guarantee value of quantizing precision information which is the quantizing precision information to have a minimum assured amplitude when decoding in each frequency band;

a quantizing processing unit which quantizes at a quantizing precision of each frequency band that is higher than or equal to the quantizing precision indicated by said guarantee value of said quantizing precision information, by using the output value of said relative quantizing precision decision unit and the output value of said quantizing precision guarantee value decision unit; and a coding unit which codes the information quantized in said quantizing processing unit, and generates audio coded data;

wherein said quantizing processing unit quantizes so that the coded data from said coding unit is less than or equal to the predetermined information quantity.

11. The data coding apparatus of claim 10, wherein said quantizing precision guarantee value decision unit calculates the guarantee value of the quantizing precision information so that at least one of the frequency spectrum decoded by using the quantizing precision information of the frequency band is more than zero, when at least one of the frequency spectrum of the input signal is more than zero in each frequency band; and said quantizing processing unit quantizes the amplitude of each frequency band at the quantizing precision higher than or equal to the precision of the output of said quantizing precision guarantee value decision unit in each frequency band.

12. The data coding apparatus of claim 10, wherein said quantizing precision guarantee value decision unit calculates, as the guarantee value, the quantizing precision information of maximum limit at which the frequency information decoded by using the quantizing data obtained by quantizing the frequency band is not sensed audibly as noise, when at least one of the spectrums of the input signal is more than zero in each frequency band; and said quantizing processing unit quantizes the amplitude of each frequency band with the quantizing precision more than or equal to the precision issued by said quantizing precision guarantee value decision unit in all frequency bands.

13. The data coding apparatus of claim 11, wherein said quantizing precision guarantee value decision unit calculates in each frequency band, as the guarantee value of the quantizing precision information, the higher quantizing precision in the lower frequency band, and the lower quantizing precision in the higher frequency band.

14. The data coding apparatus of claim 13, wherein said quantizing processing unit comprises:

a quantizing precision checking unit which calculates absolute quantizing precision information ASF(B) in each frequency band to be actually quantized, supposing each frequency band to be B, a common scale factor Com which is a specific full band quantizing precision information in all bands, a scale factor SF(B) which is said relative quantizing precision information determined in said relative quantizing precision decision unit, and said guarantee value K(B) of said quantizing precision information determined in said quantizing precision guarantee value decision unit;

a quantizing unit which quantizes frequency information on the basis of said absolute quantizing precision information ASF(B) in each frequency band calculated by said quantizing precision checking unit;

a judging unit which calculates the information quantity necessary for coding the quantized data quantized by said quantizing unit, judges the difference between the calculated information quantity and the predetermined information quantity, and terminates the quantizing process when the calculated information quantity is less than or equal to said predetermined information quantity; and a precision setting unit which instructs said quantizing precision checking unit to change said common scale factor Com when the information quantity calculated in said judging unit is judged to be larger than the predetermined information quantity.

15. The data coding apparatus of claim 14, wherein said quantizing precision checking unit sets the absolute quantizing precision information ASF(B) in each frequency band as the difference (SF(B)−Com) when the difference (SF(B)−Com) between the scale factor SF(B) and the common scale factor Com is larger than said guarantee value K(B); and sets the absolute quantizing precision information ASF(B) in each frequency band as said guarantee value K(B) when said difference (SF(B)−Com) is smaller than or equal to said guarantee value K(B).

16. The data coding apparatus of claim 15, wherein said quantizing precision guarantee value decision unit calculates the value K(B) based on the following formula:

$$(\text{float})\{\text{Max } Mdct(B)^{(3/4)}\times 2^{(3\cdot k(B)/16)}\}=P(B),$$

where, (float) means returning of the value in the subsequent formula by the value of floating decimal point, Mdct(i)(i=0, 1, . . . s) are coefficients of a modified cosine transformation, the frequency band B is frequency band frame $f_j$ to $f_k$ ($0\leqq j<k\leqq s$) and audible characteristic variable P(B) is larger than 1 and the lower the frequency, the higher the level of P(B); and the Max Mdct(B) is shown as follows, $$\text{Max } Mdct(B)=\text{Max}\{Mdct(j), Mdct(j+1), \ldots Mdct(k)\}.$$

17. The data coding apparatus of claim 10, wherein said quantizing processing unit comprises:

a quantizing precision checking unit which calculates absolute quantizing precision information ASF(B) in each frequency band to be actually quantized, supposing each frequency band to be B, a common scale factor Com which is a specific full band quantizing precision information in all bands, a scale factor SF(B) which is said relative quantizing precision information determined in said relative quantizing precision decision unit, and said guarantee value K(B) of said quantizing precision information determined in said quantizing precision guarantee value decision unit;

a quantizing unit which quantizes frequency information on the basis of said absolute quantizing precision information ASF(B) in each frequency band calculated by said quantizing precision checking unit;

a judging unit which calculates the information quantity necessary for coding the quantized data quantized by said quantizing unit, judges the difference between the calculated information quantity and the predetermined information quantity, and terminates the quantizing process when the calculated information quantity is less than or equal to said predetermined information quantity; and a precision setting unit which instructs said quantizing precision checking unit to change said common scale factor Com when the information quantity calculated in said judging unit is judged to be larger than the predetermined information quantity.

18. The data coding apparatus of claim 17, wherein said quantizing precision checking unit sets the absolute quantizing precision information ASF(B) in each frequency band as the difference (SF(B)−Com) when the difference (SF(B)−Com) between the scale factor SF(B) and the common scale factor Com is larger than said guarantee value K(B); and sets the absolute quantizing precision information ASF(B) in each frequency band as said guarantee value K(B) when said difference (SF(B)−Com) is smaller than or equal to said guarantee value K(B).

19. A data coding method for quantizing and coding an audio signal divided into plural frequency bands at a quantizing precision determined in each frequency band, comprising the following steps of:

calculating relative quantizing precision information used in quantizing from representative frequency information, where said representative frequency information is a representative value of the amplitude of each frequency band, and said relative quantizing precision information is quantizing precision information relative to the amplitude of each frequency band;

calculating a guarantee value of quantizing precision information which is the quantizing precision information to have a minimum assured amplitude when decoding in each frequency band;

quantizing at a quantizing precision of each frequency band that is higher than or equal to the quantizing precision indicated by said guarantee value of said quantizing precision information, by using said relative quantizing precision and said quantizing precision guarantee value; and coding the information quantized in said quantizing processing step, and generating audio coded data which is less than or equal to a predetermined information quantity.

20. A computer-readable storage medium embodying program instructions for said method of claim 19.

21. A data coding method for quantizing and coding an audio signal divided into plural frequency bands at a quantizing precision determined in each frequency band, comprising the following steps of:

calculating relative quantizing precision information used in quantizing from representative frequency information, where said representative frequency information is a maximum value of the amplitude of each frequency band, and said relative quantizing precision information is quantizing precision information relative to the amplitude of each frequency band;

calculating a guarantee value of quantizing precision information which is the quantizing precision information to have a minimum assured amplitude when decoding in each frequency band;

quantizing at a quantizing precision of each frequency band that is higher than or equal to the quantizing precision indicated by said guarantee value of said quantizing precision information, by using said relative quantizing precision and said quantizing precision guarantee value; and coding the information quantized in said quantizing processing step, and generating audio coded data which is less than or equal to a predetermined information quantity.

22. A computer-readable storage medium embodying program instructions for said method of claim 21.

* * * * *

UNITED STATES PATENT AND TRADEMARK OFFICE

CERTIFICATE OF CORRECTION

PATENT NO. : 6,678,653 B1
DATED : January 13, 2004
INVENTOR(S) : Mineo Tsushima et al.

It is certified that error appears in the above-identified patent and that said Letters Patent is hereby corrected as shown below:

Column 10,
Line 42, "(0f≦j<k≦s)" should read -- (0≦j<k≦s) --

Signed and Sealed this

Eighteenth Day of May, 2004

JON W. DUDAS
*Acting Director of the United States Patent and Trademark Office*